US009752330B2

(12) United States Patent
Ohshima et al.

(10) Patent No.: US 9,752,330 B2
(45) Date of Patent: Sep. 5, 2017

(54) BASE ISOLATION FLOOR STRUCTURE

(71) Applicant: SENQCIA CORPORATION, Tokyo (JP)

(72) Inventors: Takashi Ohshima, Saitama (JP); Shinpei Hosaka, Saitama (JP)

(73) Assignee: SENQCIA CORPORATION, Tokyo (JP)

( * ) Notice: Subject to any disclaimer, the term of this patent is extended or adjusted under 35 U.S.C. 154(b) by 121 days.

(21) Appl. No.: 14/346,148

(22) PCT Filed: Jun. 20, 2013

(86) PCT No.: PCT/JP2013/066925
§ 371 (c)(1),
(2) Date: Mar. 20, 2014

(87) PCT Pub. No.: WO2014/203367
PCT Pub. Date: Dec. 24, 2014

(65) Prior Publication Data

US 2016/0097205 A1 Apr. 7, 2016

(51) Int. Cl.
*E04F 15/22* (2006.01)
*E04F 15/024* (2006.01)
(Continued)

(52) U.S. Cl.
CPC ..... *E04F 15/02447* (2013.01); *E04B 1/36* (2013.01); *E04B 1/98* (2013.01);
(Continued)

(58) Field of Classification Search
CPC ... E04F 15/22; E04F 15/225; E04F 15/02447; E04F 15/02044; E04F 15/02458;
(Continued)

(56) References Cited

U.S. PATENT DOCUMENTS 4,726,161 A * 2/1988 Yaghoubian ..... E04H 9/023 248/585
5,081,806 A * 1/1992 Pommelet ..... E04H 9/023 52/167.5
(Continued)

FOREIGN PATENT DOCUMENTS

JP S62146478 A 6/1987
JP 2000266115 A 9/2000
(Continued)

*Primary Examiner* — Jessica Laux
(74) *Attorney, Agent, or Firm* — Bacon & Thomas, PLLC

(57) ABSTRACT

Provided is a base isolation floor structure containing a base isolation frame containing plural frames, and plural base isolation bearings that support the base isolation frame, in which the base isolation bearing contains a base isolation structure that has plural rolling member and is disposed horizontally movably freely on a floor surface, a connecting member that is disposed above the base isolation structure and is connected to the base isolation frame, an elastic plate member that is disposed between the connecting member and the base isolation structure, and a rod member having one end thereof that extends downward and is fixed to the base isolation structure, and the other end thereof that extends upward and is inserted with an allowance into a through hole formed in the connecting member.

6 Claims, 15 Drawing Sheets

(51) Int. Cl.

| | |
|---|---|
| ***E04B 5/43*** | (2006.01) |
| ***E04B 1/36*** | (2006.01) |
| ***E04B 1/98*** | (2006.01) |
| *E04F 15/02* | (2006.01) |

(52) U.S. Cl.
CPC ..... *E04B 5/43* (2013.01); *E04F 15/02044* (2013.01); *E04F 15/02458* (2013.01); *E04F 15/225* (2013.01); *E04F 2015/02061* (2013.01)

(58) Field of Classification Search
CPC .. E04F 2015/02061; E02D 27/34; E04H 9/00; E04H 9/02; E04H 9/021; E04H 9/022; E04H 9/023; E04H 9/024; E04B 1/36; E04B 1/98; E04B 1/985; E04B 5/43
See application file for complete search history.

(56) References Cited

U.S. PATENT DOCUMENTS 5,564,237 A * 10/1996 Yoneda ..... E04H 9/023 52/167.4
2001/0046416 A1* 11/2001 Mano ..... E02D 27/34 405/255
2002/0166296 A1* 11/2002 Kim ..... E04H 9/023 52/167.5
2003/0099413 A1* 5/2003 Lee ..... E04H 9/023 384/36
2004/0221520 A1* 11/2004 Chiang ..... E04H 9/023 52/167.1
2006/0125161 A1* 6/2006 Tsai ..... E02D 27/34 267/136
2007/0130848 A1* 6/2007 Tsai ..... E04H 9/023 52/167.7

FOREIGN PATENT DOCUMENTS

| | | | |
|---|---|---|---|
| JP | 2001241502 | A | 9/2001 |
| JP | 2003184949 | A | 9/2006 |
| JP | 2009136599 | A | 6/2009 |
| JP | 2010511848 | A | 4/2010 |

* cited by examiner

BASE ISOLATION FLOOR STRUCTURE

BACKGROUND OF THE INVENTION

Field of the Invention

The present invention relates to a base isolation floor structure that is used, for example, as a floor structure, such as a free access floor, and operates a base isolation function against vibration and displacement of a building on earthquake or the like.

Description of the Conventional Art

Examples of the ordinary base isolation floor structure include a base isolation floor structure 2 shown in FIG. 15 that is disposed on a flat floor surface 5*a*, which is formed on a sole plate 5 in the form of a flat plate laid on a foundation floor surface 3 formed of a concrete slab (see FIG. 10 of JP-A-2000-266115).

The ordinary base isolation floor structure 2 contains plural horizontally moving structures 4 (i.e., base isolation structure) that are provided horizontally movably on the floor surface 5*a* of the sole plates 5, and thereby vibration and displacement in the horizontal direction of the building caused by earthquake or the like are prevented from being transmitted directly to a floor board 6 fixed on the horizontally moving structures 4 and a free access floor or the like, which is not shown in the figure, disposed on the floor board 6.

The horizontally moving structure 4 of the ordinary base isolation floor structure 2 has a space S having an annular horizontal cross sectional shape between a convex spherical surface 10*a* of an inner member 10 and a concave spherical surface 12*a* of an outer member 12. The horizontally moving structure 4 is provided horizontally movably with respect to the floor surface 5*a* of the sole plates 5 through guidance of plural balls 8 (i.e., rolling members) disposed between the floor surface 5*a* and a bottom surface 10*b* of the inner member 10 and inside the space S.

An upper surface 12*b* of the horizontally moving structure 4 has the floor board 6 in the form of a flat plate placed thereon. The floor board 6 is fixed to the outer member 12 through screw engagement of an external thread of a bolt 14 and an internal thread 12*c* of the outer member 12. An upper surface 6*a* of the floor board 6 has an free access floor, which is not shown in the figure, placed thereon and fixed thereto.

In the ordinary base isolation floor structure 2, the floor board 6 can move freely in any direction within the approximately horizontal surface on the floor surface 5*a* through horizontal movement of the plural horizontally moving structures 4 fixed to the floor board 6 with respect to the floor surface 5*a* of the sole plates 5.

PRIOR ART DOCUMENT

Patent Document

JP-A-2000-266115

SUMMARY OF THE INVENTION

Problem to be Solved by the Invention

However, the ordinary base isolation floor structure 2 does not have such a structure that the balls 8 are retained by the horizontally moving structure 4 or the like, and thus has such a problem that in the case where a foundation floor surface 3 has a portion having unevenness (i.e., inclination and roughness that impair the flatness) formed thereon, the floor surface 5*a* of the sole plates 5 also has unevenness formed thereon, and between the floor surface 5*a* and the bottom surface 10*b* of the inner member 10, a part of the balls 8 of the horizontally moving structure 4 are released off from the bottom surface 10*b* of the inner member 10, thereby deteriorating the base isolation performance.

In the ordinary base isolation floor structure 2, furthermore, in the case where the floor board 6 are floated up due to vibration and displacement of a building caused by earthquake or the like, there is such a problem that the horizontally moving structures 4 fixed to the floor board 6 are also floated up simultaneously, and also in this case, a large number of the balls 8 are released and scattered off from the bottom surface 10*b* of the inner member 10, thereby deteriorating the base isolation performance.

As measures for solving the problems, it may be considered that a smooth surface without unevenness is formed on the foundation floor surface 3, the sole plate 5 having a large thickness is used, and the weight of the floor board 6, the free access floor or the like is increased to prevent the horizontally moving structures 4 from being floated up, but these measures have a problem of large amounts of labor and cost.

An object of the invention is to provide such a base isolation floor structure that even when the floor surface has a portion having unevenness formed thereon, or when the base isolation frame is floated up due to earthquake or the like, the base isolation floor structure is prevented from suffering deterioration of the base isolation performance thereof caused by releasing the rolling members off from a part of the base isolation structure.

Means for Solving the Problem

For solving the problems, the base isolation floor structure according to the invention includes a base isolation floor structure containing: a base isolation frame containing plural frames; and plural base isolation bearings that support the base isolation frame, the base isolation bearing containing:

a base isolation structure that has plural rolling member and is disposed horizontally movably freely on a floor surface;

a connecting member that is disposed above the base isolation structure and is connected to the base isolation frame;

an elastic plate member that is disposed between the connecting member and the base isolation structure; and a rod member having one end thereof that extends downward and is fixed to the base isolation structure, and the other end thereof that extends upward and is inserted with an allowance into a through hole formed in the connecting member.

The base isolation floor structure according to the invention further contains a coil spring that is disposed between the connecting member and the base isolation structure.

For solving the problems, the base isolation floor structure according to the invention also includes a base isolation floor structure containing: a base isolation frame containing plural frames; and plural base isolation bearings that support the base isolation frame, the base isolation bearing containing:

a base isolation structure that has plural rolling member and is disposed horizontally movably freely on a floor surface;

a connecting member that is disposed above the base isolation structure and is connected to the base isolation frame;

a coil spring that is disposed between the connecting member and the base isolation structure; and a rod member having one end thereof that extends downward and is fixed to the base isolation structure, and the other end thereof that extends upward and is inserted with an allowance into a through hole formed in the connecting member.

Effect of the Invention

According to the base isolation floor structure of the invention, the base isolation floor structure contains: a base isolation frame containing plural frames; and plural base isolation bearings that support the base isolation frame, in which the base isolation bearing contains:

a base isolation structure that has plural rolling member and is disposed horizontally movably freely on a floor surface;

a connecting member that is disposed above the base isolation structure and is connected to the base isolation frame;

an elastic plate member that is disposed between the connecting member and the base isolation structure; and a rod member having one end thereof that extends downward and is fixed to the base isolation structure, and the other end thereof that extends upward and is inserted with an allowance into a through hole formed in the connecting member, whereby even when the floor surface has a portion having unevenness formed thereon, or when the base isolation frame is floated up due to earthquake or the like, the base isolation floor structure is prevented from suffering deterioration of the base isolation performance thereof caused by releasing the rolling members off from a part of the base isolation structure.

According to the base isolation floor structure of the invention, furthermore, the base isolation floor structure contains: a base isolation frame containing plural frames; and plural base isolation bearings that support the base isolation frame, in which the base isolation bearing contains:

a base isolation structure that has plural rolling member and is disposed horizontally movably freely on a floor surface;

a connecting member that is disposed above the base isolation structure and is connected to the base isolation frame;

a coil spring that is disposed between the connecting member and the base isolation structure; and a rod member having one end thereof that extends downward and is fixed to the base isolation structure, and the other end thereof that extends upward and is inserted with an allowance into a through hole formed in the connecting member, whereby even when the floor surface has a portion having unevenness formed thereon, or when the base isolation frame is floated up due to earthquake or the like, the base isolation floor structure is prevented from suffering deterioration of the base isolation performance thereof caused by releasing the rolling members off from a part of the base isolation structure.

DESCRIPTION OF REFERENCE NUMERALS

Figure 1:
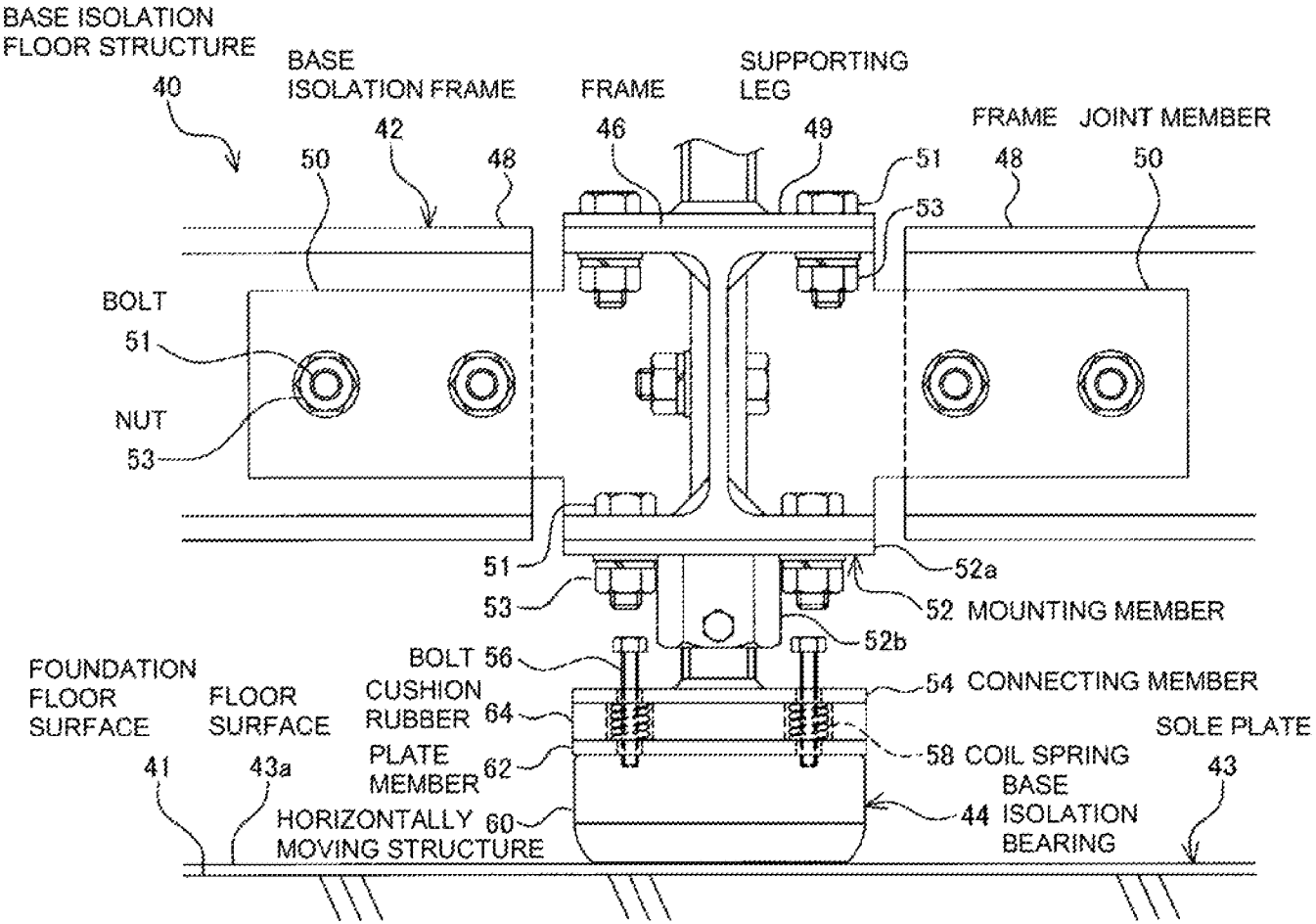
FIG. 1 is a side view showing a base isolation floor structure 40 according to a first embodiment of the invention.

2 base isolation floor structure
3 foundation floor surface
4 horizontally moving structure
5 sole plate
5*a* floor surface
6 floor board
6*a* upper surface
8 ball
10 inner member
10*a* convex spherical surface
10*b* bottom surface
12 outer member
12*a* concave spherical surface

12*b* upper surface
12*c* internal thread
14 bolt
40 base isolation floor structure
41 foundation floor surface
42 base isolation frame
43 sole plate
43*a* floor surface
44 base isolation bearing
46, 48 frame
49 supporting leg
50 joint member
51 bolt
52 mounting member
52*a* flat plate portion
52*b* cylinder portion
52*c* internal thread
53 nut
54 connecting member
54*a* flat plate portion
54*b* protruding portion
54*c* through hole
54*d* external thread
56 bolt
56*a* external thread
58 coil spring
60 horizontally moving structure
62 plate member
62*a* through hole
64 cushion rubber
64*a* through hole
64*b* upper surface
64*c* bottom surface
64*d*, 64*e* groove
66 locking screw
70 ball
72 inner member
72*a* convex spherical surface
72*b* cylinder portion
72*c* upper surface
72*d* bottom surface
72*e* internal screw
74 outer member
74*a* concave spherical surface
74*b* recessed portion
74*c* upper surface
74*d* bottom surface
74*e* dish-shaped hole
74*f* internal thread
74*g* opening
76 countersunk screw
76*a* external thread
80 base isolation floor structure
82 base isolation bearing
84 connecting member
84*a* flat plate portion
84*b* protruding portion
84*c* through hole
84*d* external thread
84*e* downward protruding portion
84*f* convex spherical surface portion
100 base isolation floor structure
102 base isolation bearing
104 connecting member
104*a* flat plate portion
104*b* protruding portion
104*c* through hole
104*d* external thread
106 first round rod member
108 plate member
108*a* through hole
110 second round rod member
120 base isolation floor structure
122 base isolation bearing
F restoring force
S space
W welding

DETAILED DESCRIPTION OF PREFERRED EMBODIMENTS

Embodiments for carrying out the base isolation floor structure according to the invention will be described specifically with reference to the drawings.

FIGS. 1 to 8 are figures that are referred to for describing a base isolation floor structure 40 according to the first embodiment of the invention.

A base isolation floor structure 40 of this embodiment has a base isolation frame 42 having frames 46 and 48 and a joint member 50, and the base isolation frame 42 is supported from below with plural base isolation bearings 44.

In the base isolation frame 42, the frames 46 and 48, each of which is formed of an H-section steel, are disposed in such a manner that the longitudinal directions thereof intersect with each other approximately perpendicularly in the horizontal plane, and plural frames 46 and 48 are combined and disposed in the form of a lattice as viewed from the above.

The frames 46 and 48 are connected at the adjacent parts thereof through a joint member 50 and are fixed to each other.

Specifically, the plate-like portion at the cross sectional center of the H-section of the frame 48 is superimposed on one of the plate-like portions of the joint member 50 in the form of a plate having been bent at 90°, and is fixed to the joint member 50 through screw engagement of an external thread of a bolt 51 penetrating through the through holes formed in the plate-like portions and an internal thread of a nut 53. The frame 46 is also fixed to the other plate-like portion of the joint member 50 in the same manner.

A supporting leg 49 of a free access floor is placed on the upper flange of the frame 46 as in FIG. 1, and the bottom plate of the supporting leg 49 is fixed thereto through screw engagement of a bolt 51 and a nut 53.

A base isolation bearing 44 under the frames 46 and 48 has a mounting member 52, a connecting member 54, a bolt 56 (i.e., a rod member), a coil spring 58, a horizontally moving structure 60 (i.e., a base isolation structure), a plate member 62 and cushion rubber 64 (i.e., an elastic plate member), and the base isolation bearing 44 is disposed on a floor surface 43*a* of plural sole plates 43 in the form of a thin plate laid on a foundation floor surface.

Figure 2:
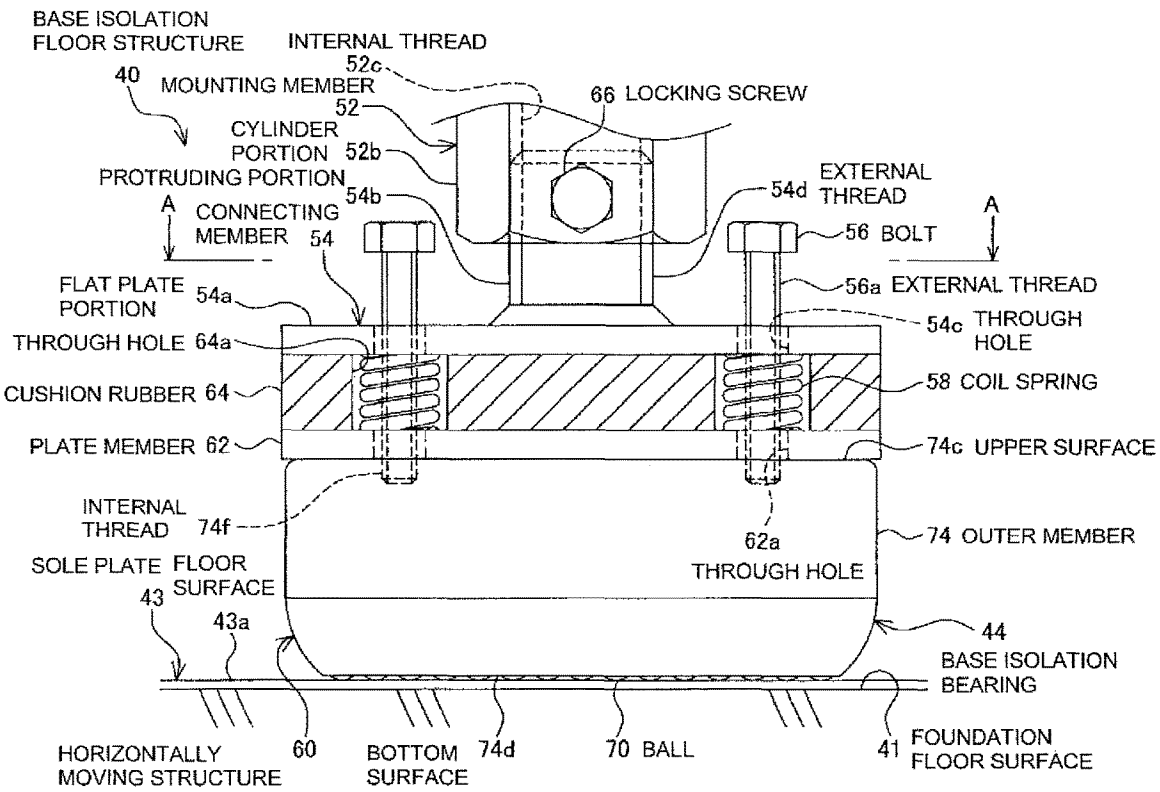
FIG. 2 is a partially cross partial sectional side view showing an enlarged view around a base isolation bearing 44 of the base isolation floor structure 40 in FIG. 1.

The mounting member 52 of the base isolation bearing 44 has a flat plate portion 52*a* having a approximately square plate shape and a cylinder portion 52*b* having a hexagonal outer shape protruding downward from the center of the flat plate portion 52*a*, and the cylinder portion 52*b* has an internal thread 52*c* on the inner circumferential portion thereof (see FIG. 2).

The flat plate portion 52*a* of the mounting member 52 is in contact with the lower flange of the frame 46 as in FIG. 1, and is fixed to the lower flange of the frame 46 as in the figure through screw engagement of a bolt 51 and a nut 53.

Figure 3:
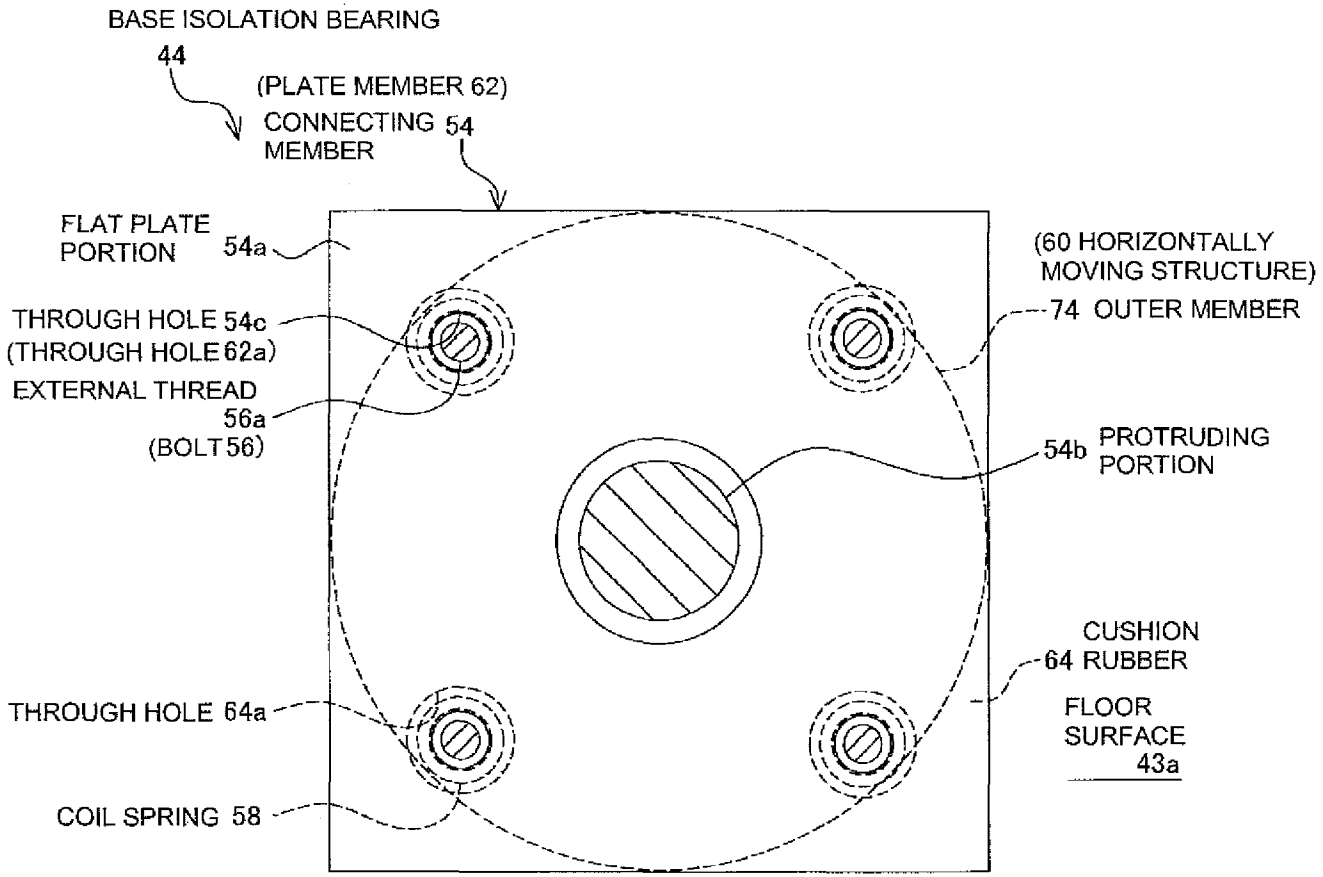
FIG. 3 is a cross sectional view of the base isolation bearing 44 on line A-A in FIG. 2.

The connecting member 54 of the base isolation bearing 44 has a flat plate portion 54*a* having a approximately square shape and a protruding portion 54*b* protruding upward from the center of the flat plate portion 54*a* as shown in FIGS. 2 and 3, and the protruding portion 54*b* has an external thread 54*d* formed on the outer circumferential portion thereof.

As shown in FIG. 2, in the state where the external thread 54*d* of the protruding portion 54*b* of the connecting member 54 is screwed into the internal thread 52*c* formed in the cylinder portion 52*c* of the connecting member 52, the connecting member 54 may be rotated relatively with the mounting member 52, and thereby the distance between the flat plate portions 52*a* and 54*a* may be adjusted. According to the procedure, the height position of the base isolation frame 42 fixed to the mounting member 52 from the floor surface 43*a* of the sole plate 43 may also be adjusted.

The mounting member 52 and the connecting member 54 are fixed to each other non-relatively rotatably by screwing an external thread of a locking screw 66 into an internal screw hole, which is not shown in the figure, formed on the lower end of the mounting member 52.

The flat plate portion 54*a* of the connecting member 54 has at the four corners thereof through holes 54*c*, through each of which an intermediate portion in the longitudinal direction of an external thread 56*a* of the bolt 56 penetrates with an allowance.

The plate member 62 of the base isolation bearing 44 has the same shape as the flat plate portion 54*a* of the connecting member 54 as shown in FIGS. 2 and 3. Specifically, the plate member 62 is formed in a approximately square plate shape, and through holes 62*a* formed at the four corners thereof are formed with the same diameter as the through holes 54*c* of the connecting member 54 at the coaxial positions of the through holes 54*c* on superimposing the plate member 62 onto the flat plate portion 54*a* of the connecting member 54.

The plate member 62 is placed on an upper surface 74*c* of an outer member 74 of the horizontally moving structure 60. Four coil springs 58 and cushion rubber 64 are placed on the plate member 62.

The cushion rubber 64 of the base isolation bearing 44 is formed in a approximately square plate shape as shown in FIGS. 2 and 3, and through holes 64*a* each formed at the four corners thereof are formed with a larger diameter than the through holes 54*c* of the connecting member 54 at the coaxial positions of the through holes 54*c* on superimposing onto the flat plate portion 54*a* of the connecting member 54. The coil springs 58 are disposed in the four through holes 64*a* of the cushion rubber 64, respectively.

The cushion rubber 64 is shown in the figures other than FIG. 4 with omission of grooves 64*d* and 64*e* described below, for the sake of explanation.

Figure 4:
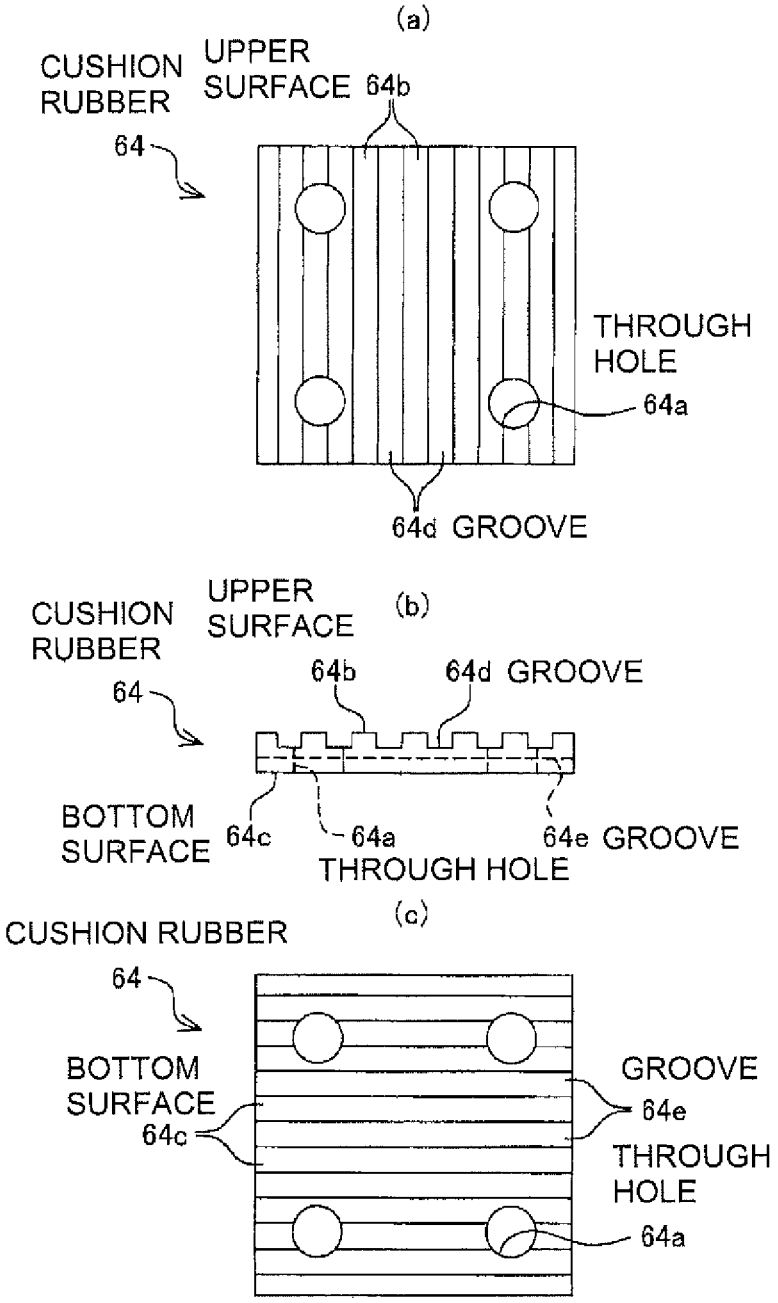
FIG. 4 includes figures showing cushion rubber 64, in which FIG. 4(*a*) is a top plan view thereof, FIG. 4(*b*) is an elevational view thereof, and FIG. 4(*c*) is a bottom plan view thereof.

Specifically, the cushion rubber 64 has, as shown in FIG. 4(*b*), plural grooves 64*d* that are recessed in a squared U-shape from an upper surface 64*b* thereof, extend in parallel to one edge thereof extending in the vertical direction as in FIG. 4(*a*), and are formed adjacent to each other in the horizontal direction as in the figure.

The cushion rubber 64 has plural grooves 64*e* that are recessed in a squared U-shape from a bottom surface 64*c* thereof, extend in one edge that is in parallel to the horizontal direction as in FIG. 4(*c*), and are formed adjacent to each other in the vertical direction as in the figure.

The cushion rubber 64 can be deflected and can decrease the thickness dimension thereof on application of pressure.

The cushion rubber 64 is held between the flat plate portion 54*a* of the connecting member 54 and the plate member 62 as shown in FIG. 2, and thereby the cushion rubber 64 decreases the vibration transmission between the flat plate portion 54*a* of the connecting member 54 and the plate member 62, and exhibits an effect of relaxing and absorbing accidental impact energy and an effect of attenuating vibration.

The four bolts 56 shown in FIG. 3 each have the external thread 56*a* that penetrates with an allowance through the through hole 54*c* of the connecting member 54, the through hole 64*a* of the cushion rubber 64, the interior of the coil spring 58 and the through hole 62*a* of the plate member 62 in this order from the upper surface of the flat plate 54*a* of the connecting member 54, as shown in FIG. 2.

The four bolts 56 are fixed to the horizontally moving structure 60 through screw engagement of tip ends of the external threads 56*a* thereof that protrude downward from the plate member 62 with internal threads 74*f* (see FIG. 6) that are opened and formed at four positions on the upper surface 74*c* of the outer member 74 of the horizontally moving structure 60.

Figure 5:
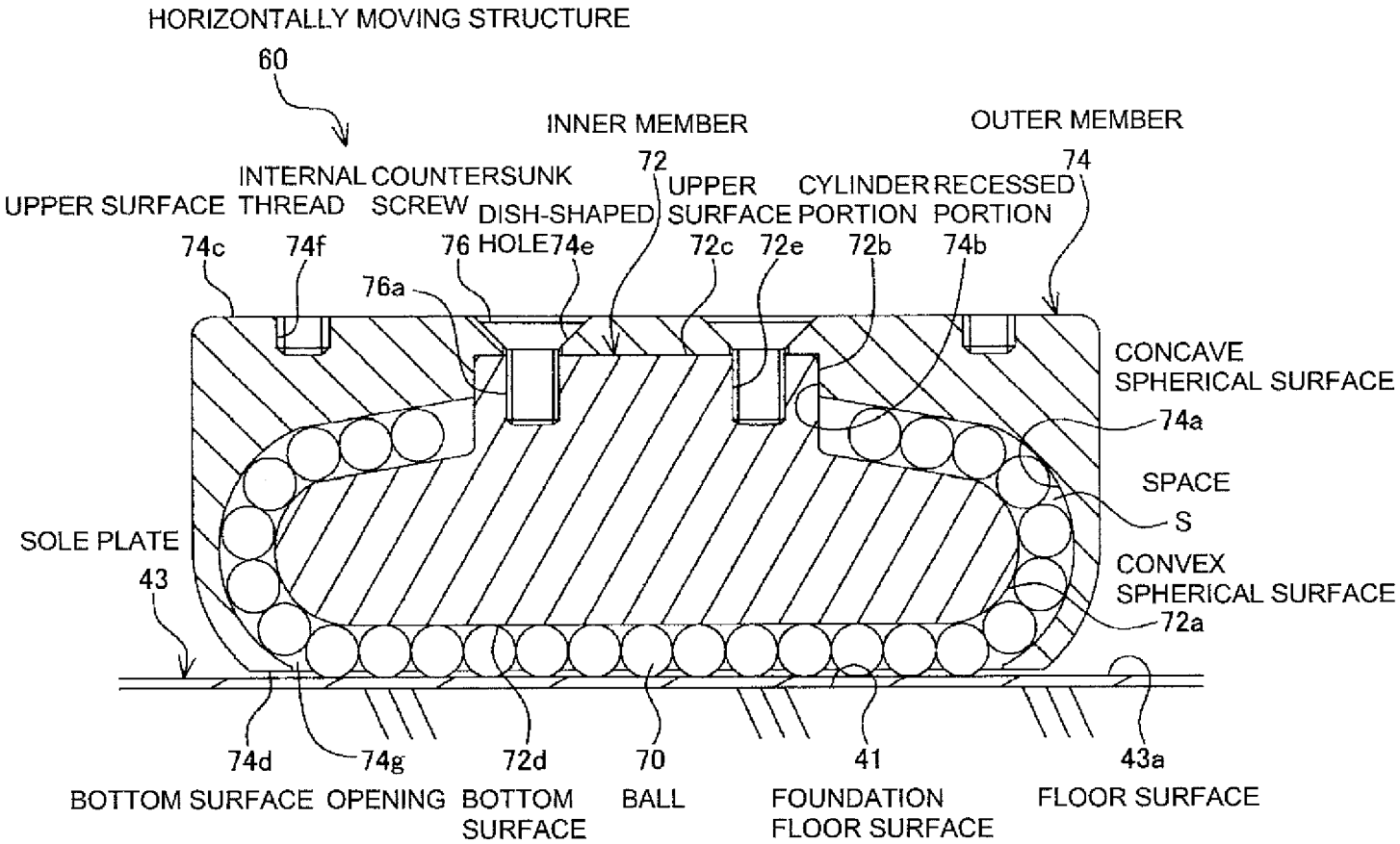
FIG. 5 is a figure showing a horizontally moving structure 60 and is a cross sectional view of the horizontally moving structure 60 on line B-B in FIG. 6.
Figure 6:
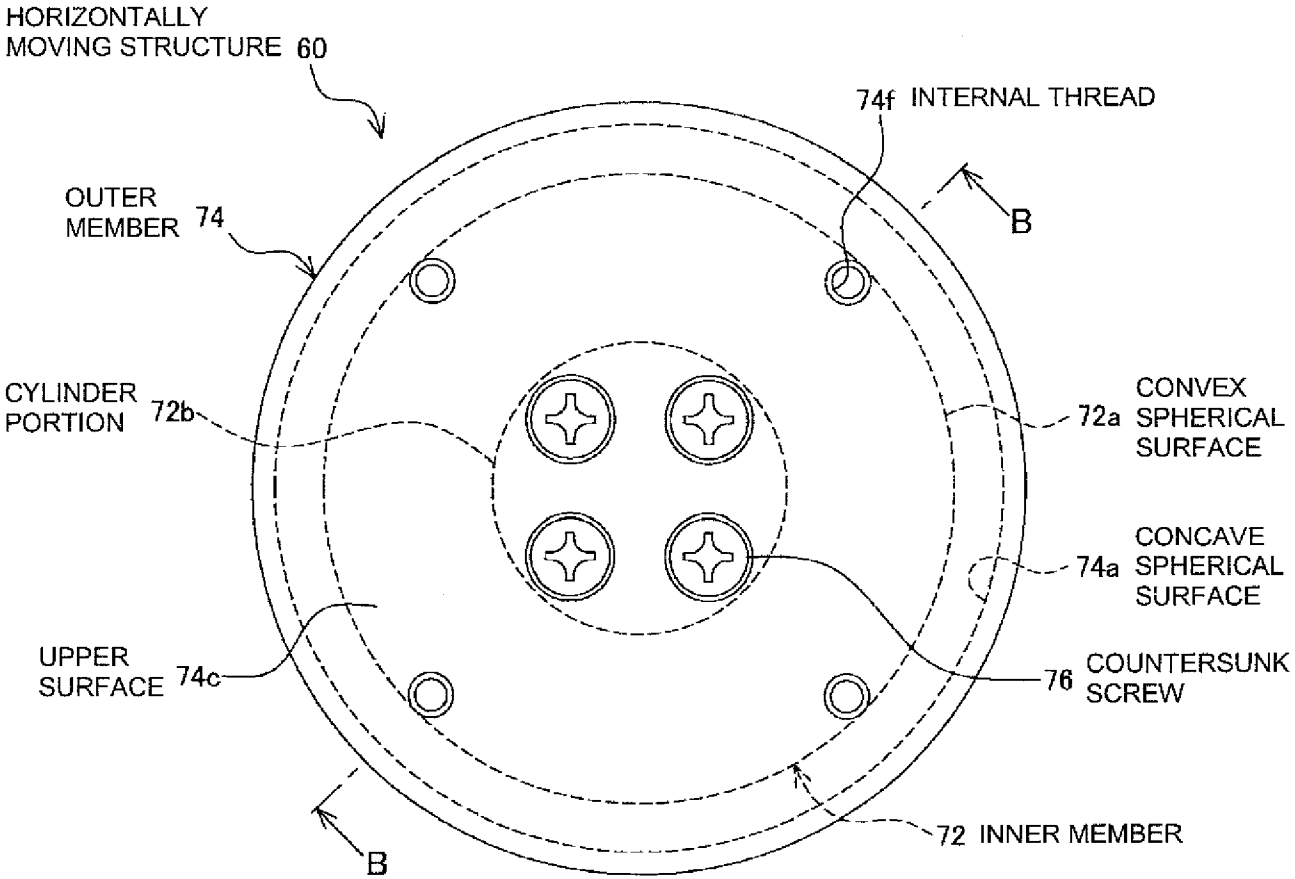
FIG. 6 is a top plan view of the horizontally moving structure 60 shown in FIG. 5.

The horizontally moving structure 60 of the base isolation bearing 44 shown in FIG. 1 has plural balls 70 (i.e., rolling members), an inner member 72 and an outer member 74, as shown in FIGS. 5 and 6.

The inner member 72 is formed in a disk shape having a convex spherical surface 72*a* on the outer circumference cross section and has a cylinder portion 72*b* that protrudes upward from the center of the upper side of the inner member 72 and is integrated therewith. An upper surface 72*c* of the cylinder member 72*b* has four internal threads 72*e* opened thereon.

The outer member 74 is formed in a approximately cylindrical shape having a small height, and has on the inner cross sectional surface thereof a concave spherical surface 74*a* corresponding to the convex spherical surface 72*a* of the inner member 72. The outer member 74 has on the bottom surface thereof an opening 74*g* opened on the concave spherical surface 74*a*, and has above the opening 74*g* a recessed portion 74*b* recessed upward from the surrounding as in FIG. 5.

The outer member 74 has in the center portion on the upper surface 74*c* thereof four dish-shaped holes 74*e* penetrating through the upper surface 74*c* to the ceiling surface of the recessed portion 74*b*.

The outer member 74 is fixed to the inner member 72 in such a manner that the cylinder portion 72*b* of the inner member 72 is inserted into the recessed portion 74*b* of the outer member 74, external threads 76*a* of countersunk screws 76 are inserted into the dish-shaped holes 74*e* of the outer member 74, and the tip ends of the external threads 76*a* are screwed in and engaged with the internal threads 72*e* of the inner member 72.

As shown in FIG. 5, a space S curved in the vertical cross section, in which spherical balls 70 formed of a metal are capable of rolling, is formed between the concave spherical surface 74*a* of the outer member 74 and the convex spherical surface 72*a* of the inner member 72. The space S has an annular shape in the horizontal cross section at the center in height of the outer member 74.

The balls 70 are disposed adjacent to each other along the center lines of the space S and a space between the bottom surface 72*d* of the inner member 72 and the floor surface 43*a* of the sole plate 43.

The balls 70 are disposed between the bottom surface 72*d* of the inner member 72 and the floor surface 43*a* of the sole plate 43, and thereby the bottom surface 74*d* of the outer member 74 is disposed slightly above away from the floor surface 43*a* to prevent the bottom surface 74*d* from being in contact with the floor surface 43*a*.

When the horizontally moving structure 60 moves horizontally on the floor surface 43*a* of the sole plate 43, under the bottom surface 72*d* of the inner member 72, the balls 70 that are positioned on the opposite side of the moving direction of the horizontal movement enter into the space S and move circularly, and the balls 70 that are positioned on the side of the moving direction of the horizontal movement move toward the opposite side to the moving direction of the horizontal movement of the horizontally moving structure 60.

When the horizontally moving structure 60 moves horizontally, accordingly, the balls 70 move horizontally or move circularly by following the horizontal movement, and the base isolation frame 42 can move freely in any horizontal direction on the floor surface 43*a* of the sole plate 43 according to such an operation of the horizontally moving structure 60 guided by the balls 70.

The base isolation bearing 44 on setting up is adjusted to such a height that the connecting member 54 and the cushion rubber 64 are in contact with each other, and the cushion rubber 64 and the plate member 62 are in contact with each other, as shown in FIG. 2, through the adjustment of the height position between the mounting member 52 and the connecting member 54 described above. The base isolation floor structure 40 equipped with the base isolation bearing 44 supports the free access floor or the like disposed on the base isolation frame 42.

The external thread 56*a* of the bolt 56 is inserted loosely with an allowance into the through hole 54*c* of the flat plate portion 54*a* of the connecting member 54, the interior of the coil spring 58 and the through hole 62*a* of the plate member 62, but does not fix them.

Accordingly, the axial line of the external thread 56*a* of the bolt 56 can be inclined to a prescribed angle with respect to the axial line of the through hole 54*c*. According to the procedure, the horizontally moving structure 60 is allowed to rotate to a prescribed angle with respect to the flat plate portion 54*a* of the connecting member 54.

Figure 7:
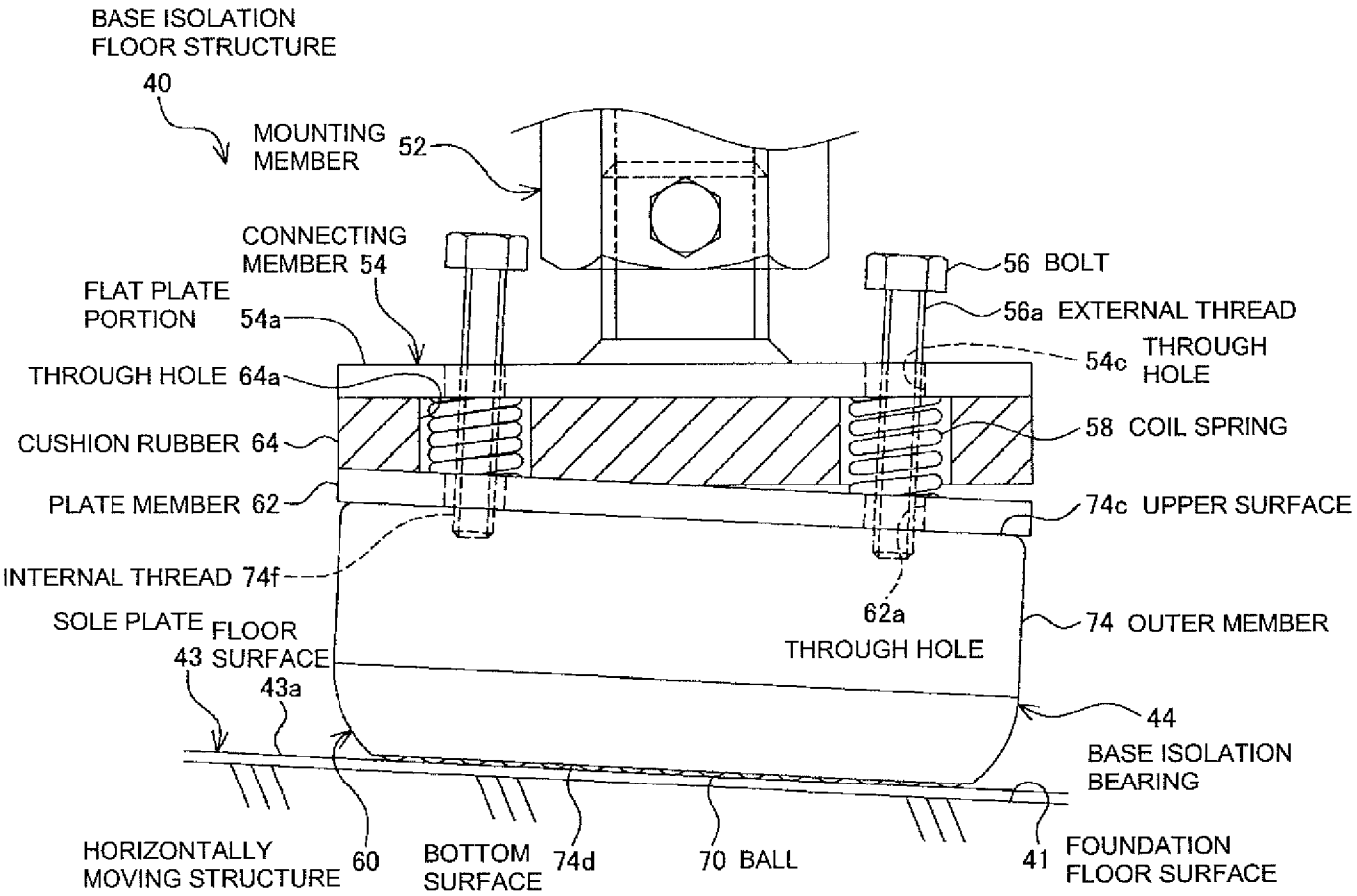
FIG. 7 is a figure showing an enlarged view around the base isolation bearing 44 of the base isolation floor structure 40 and is a side view showing the state where the base isolation bearing 44 is placed on an inclined floor surface 43*a*.

As shown in FIG. 7, specifically, in the case where the floor surface 43*a* of the sole plate 43 is inclined with respect to the horizontal plane, and the horizontally moving structure 60 is rotated to a prescribed angle with respect to the flat plate portion 54*a* of the connecting member 54 corresponding to the inclination of the floor surface 43*a*, the external thread 56*a* of the bolt 56 is not in contact with the inner circumferential surface of the through hole 54*c* of the connecting member 54.

In this case, in the left half as in FIG. 7, in which the distance between the horizontally moving structure 60 and the flat plate portion 54*a* of the connecting member 54 is decreased, the length dimension of the coil spring 58 and the thickness dimension of the cushion rubber 64 are decreased. In the right half as in FIG. 7, in which the distance between the horizontally moving structure 60 and the flat plate portion 54*a* of the connecting member 54 is increased, the length dimension of the coil spring 58 is increased.

In the base isolation floor structure 40 according to this embodiment, the relative angle of the horizontally moving structure 60 with respect to the flat plate portion 54*a* of the connecting member 54 can be changed to a certain extent corresponding to unevenness (i.e., inclination and roughness that impair the flatness) of the foundation floor surface 41 or the floor surface 43*a* of the sole plate 43, and therefore even when unevenness is formed on the foundation floor surface 41 or the floor surface 43*a* of the sole plate 43, the balls 70 positioned between the bottom surface 72*d* of the inner member 72 of the horizontally moving structure 60 and the floor surface 43*a* of the sole plate 43 can all be made in contact with the floor surface 43*a*.

The length dimension between the lower surface of the head portion of the bolt 56 and the upper surface 74*c* of the outer member 74 of the horizontally moving structure 60 is larger than the total thickness dimension of the flat plate portion 54*a* of the connecting member 54, the plate member 62 and the cushion rubber 64, and thereby the horizontally moving structure 60 supports from below the flat plate portion 54*a* of the connecting member 54 through the plate member 62 and the cushion rubber 64 or is separated downward therefrom, corresponding to the change of the distance between the lower surface of the flat plate portion 54*a* of the connecting member 54 and the floor surface 43*a* of the sole plate 43.

Specifically, in the case where the distance between the floor surface 43*a* of the sole plate 43 and the flat plate portion 54*a* of the connecting member 54 is small, and the lower surface of the head portion of the bolt 56 and the flat plate portion 54*a* of the connecting member 54 are separated from each other certainly largely as shown in FIG. 2, the flat plate portion 54*a* of the connecting member 54 is in contact with the upper surface of the cushion rubber 64, and the plate member 62 and the cushion rubber 64 are in close contact with each other between the connecting member 54 and the horizontally moving structure 60, thereby making such a state that the horizontally moving structure 60 supports from below the flat plate portion 54*a* of the connecting member 54 through the coil spring 58, the plate member 62 and the cushion rubber 64.

Figure 8:
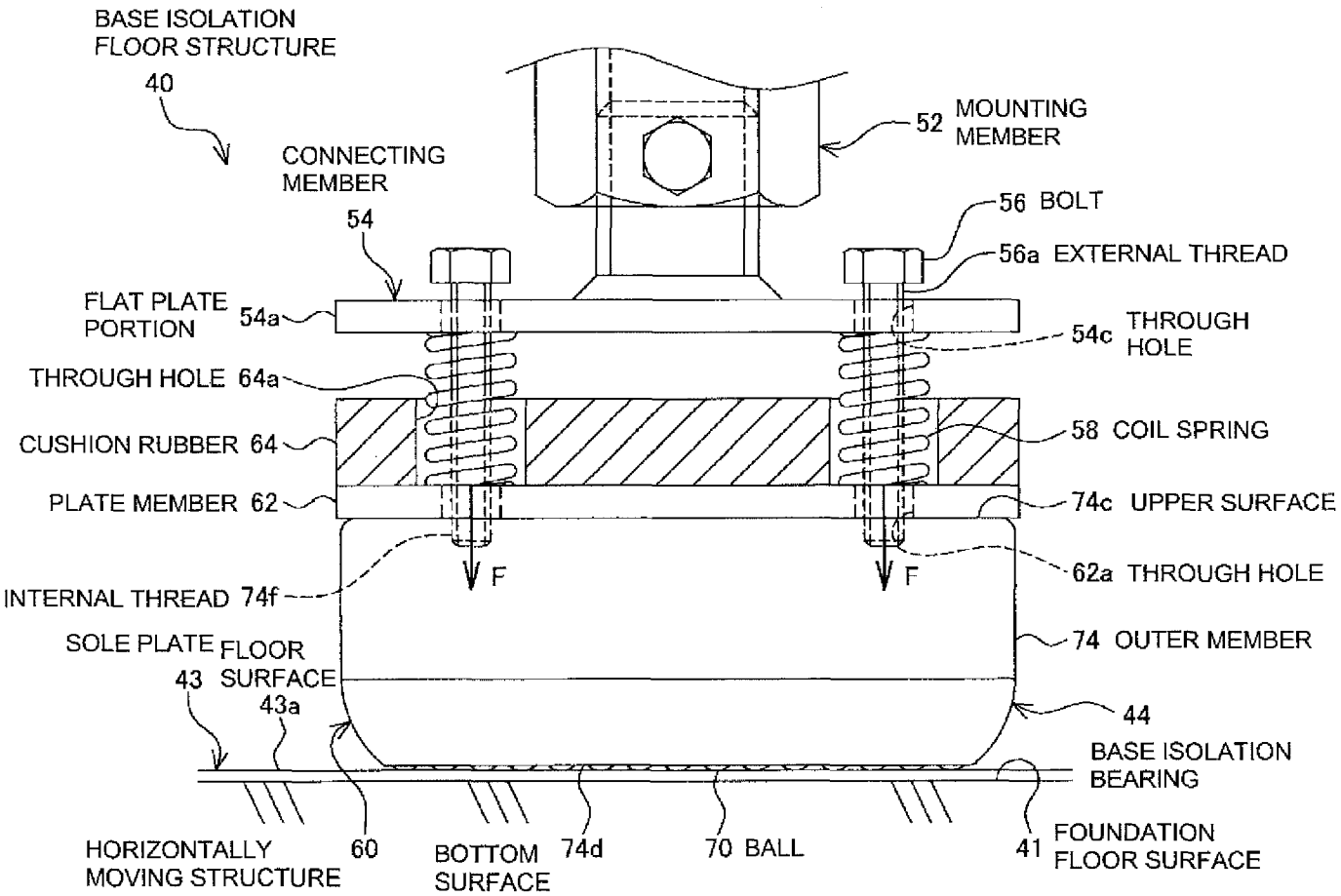
FIG. 8 is a figure showing an enlarged view around the base isolation bearing 44 of the base isolation floor structure 40 and is a side view showing the state where the base isolation bearing 44 is placed on a floor surface 43*a* that has a lower height than the other portions.

In the case where the distance between the floor surface 43*a* of the sole plate 43 and the flat plate portion 54*a* of the connecting member 54 is larger than the distance in FIG. 2, and the lower surface of the head portion of the bolt 56 is close to the flat plate portion 54*a* of the connecting member 54 as shown in FIG. 8, the flat plate portion 54*a* of the connecting member 54 is separated from the upper surface of the cushion rubber 64, thereby making such a state that the horizontally moving structure 60 supports from below the base isolation frame 42 and the like above the connecting member 54 through the coil spring 58 and the flat plate portion 54*a* of the connecting member 54.

Accordingly, the bolt 56 has such a length that when the tip end of the external thread 56*a* thereof is screwed in and engaged with the internal thread 74*c* of the horizontally moving structure 60 in the normal state, the lower surface of the head portion thereof faces the upper surface of the flat plate portion 54*a* of the connecting member 54 with a certainly large distance, but in the case where the horizontally moving structure 60 descends largely due to unevenness of the foundation floor surface 41 or the floor surface 43*a* of the sole plate 43, there is an increased possibility of contact of the lower surface of the head portion of the bolt 56 with the upper surface of the flat plate portion 54*a* of the connecting portion 54, and the horizontally moving structure 60 and the flat plate portion 54*a* of the connecting member 54 are close to the most separated state.

Thus, in the case where unevenness is formed on the foundation floor surface 41 or the floor surface 43*a* of the sole plate 43, on which one base isolation bearing 44 among the plural base isolation bearings 44 supporting the base isolation frame 42 is placed, and the height position of the floor surface 43*a* is lower than the floor surface 43*a* having the other base isolation bearings 44 placed thereon, the horizontally moving structure 60 descends downward by increasing the distance from the lower surface of the flat plate portion 54*a* of the connecting member 54, thereby making the balls 70 in contact with the floor surface 43*a*, as shown in FIG. 8.

In the case where base isolation frame 42 is floated up due to earthquake or the like, the horizontally moving structure 60 descends downward by increasing the distance from the lower surface of the flat plate portion 54*a* of the connecting member 54, thereby making the balls 70 in contact with the foundation floor surface 41.

In the case where the distance between the floor surface 43*a* and the flat plate portion 54*a* of the connecting member 54 is increased due to unevenness of the foundation floor surface 41 or the floor surface 43*a* of the sole plate 43, the horizontally moving structure 60 descends by the own weight thereof, thereby maintaining the contact state with the floor surface 43*a* as shown in FIG. 8.

As shown in FIG. 8, furthermore, the restoring force F of the coil spring 58 acts to press the horizontally moving structure 60 onto the floor surface 43*a* of the sole plate 43, and thereby the horizontally moving structure 60 can ensure the contact state with the floor surface 43*a* even in the case where the height and inclination of the floor surface 43*a* of the sole plate 43 are changed.

In the base isolation floor structure 40 according to this embodiment, the vertical distance between the flat plate 54*a* of the connecting member 54 and the horizontally moving structure 60 can be changed corresponding to the change of the height of the foundation floor surface 41 or the floor surface 43*a* of the sole plate 43 or the float-up of the base isolation frame 42 due to earthquake or the like, and thereby the balls 70 of the horizontally moving structure 60 can all be made in contact with the floor surface 43*a* of the sole plate 43 even when the floor surface 43*a* has a portion that has a height different from the other most portions, or the base isolation frame 42 is floated up.

In the base isolation floor structure 40 according to this embodiment, the base isolation bearing 44 is constituted by the mounting member 52, the connecting member 54, the supporting rod member 56 and the horizontally moving structure 60 to provide a simple structure for the base isolation bearing 44, and thus the material cost and the production cost thereof can be reduced.

In the base isolation floor structure 40 according to this embodiment, it is not necessary that the foundation floor surface 41 is formed as a smooth surface without unevenness, the thickness of the sole plate 43 is increased, or the weight of the base isolation frame 42, the free access floor or the like supported by the base isolation bearing 44 is increased, and thereby the material cost and the production cost of the base isolation floor structure 40 can be reduced.

According to the base isolation floor structure 40 according to this embodiment, as described above, even when the floor surface 43*a* has a portion having unevenness formed thereon, or the base isolation frame 42 is floated up due to earthquake or the like, the balls 70 can be prevented from being released off from a part of the horizontally moving structure 60, thereby preventing the base isolation performance from being deteriorated.

Figure 9:
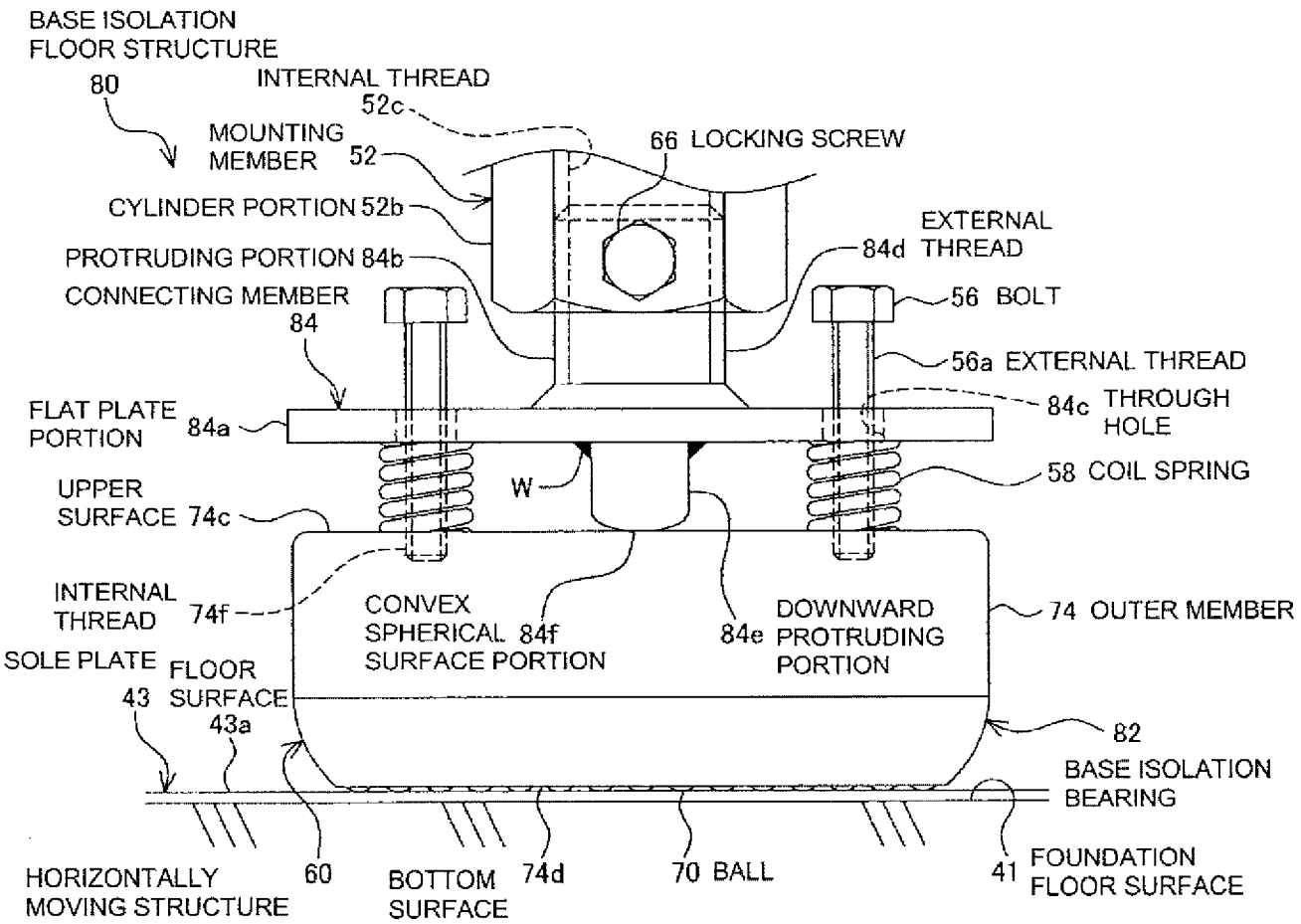
FIG. 9 is a figure showing a base isolation floor structure 80 according to a second embodiment of the invention and is a side view showing an enlarged view around a base isolation bearing 82 thereof.
Figure 10:
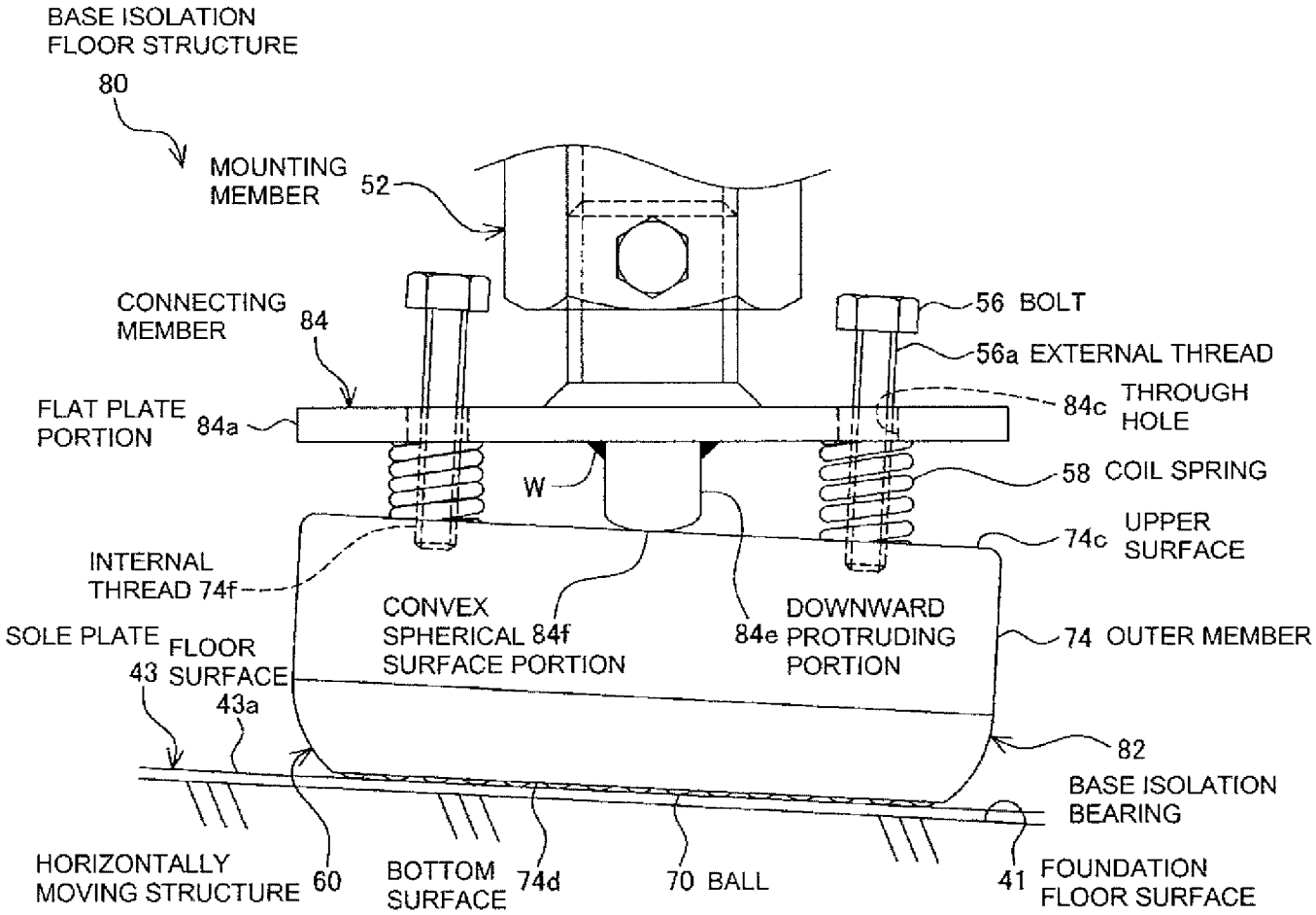
FIG. 10 is a figure showing an enlarged view around a base isolation bearing 82 of the base isolation floor structure 80 and is a side view showing the state where the base isolation bearing 82 is placed on an inclined floor surface 43*a*.

FIGS. 9 and 10 are figures for describing a base isolation floor structure 80 according to the second embodiment of the invention.

The base isolation floor structure 80 according to this embodiment is different from the base isolation floor structure 40 according to the first embodiment in the point shown in FIG. 9 that a connecting member 84 has a base isolation bearing 82 instead of the connecting member 54, the plate member 62 and the cushion rubber 64 in the first embodiment.

As shown in FIG. 9, the connecting member 84 according to this embodiment has a flat plate portion 84*a*, a protruding portion 84*b* protruding upward having an external thread 84*d*, and a through hole 84*c*, which correspond to the flat plate portion 54*a*, the protruding portion 54*b* protruding upward having the external thread 54*d*, and the through hole 54*c* of the connecting member 54 in the first embodiment, respectively.

The connecting member 84 has integrated therewith a downward protruding portion 84*e* that protrudes downward from the center of the lower surface of the flat plate portion 84*a* through welding W of an upper end of a cylinder member to the lower surface of the flat plate portion 84*a* as in FIG. 9.

The connecting member 84 has a convex spherical surface portion 84*f* at the tip end of the downward protruding portion 84*e*. The convex spherical surface portion 84*f* is in contact with the center of the upper surface 74*c* of the outer member 74 of the horizontally moving structure 60.

As shown in FIG. 9, the external thread 56*a* of the bolt 56 is inserted loosely with an allowance into the interior of the coil spring 58 and the through hole 84*c* of the flat plate portion 84*a* of the connecting member 84, but is not fixed thereto.

Accordingly, the horizontally moving structure 60 is allowed to rotate to a prescribed angle with respect to the flat plate portion 84*a* of the connecting member 84.

As shown in FIG. 10, specifically, in the case where the floor surface 43*a* of the sole plate 43 is inclined within a prescribed angle with respect to the horizontal plane, and the horizontally moving structure 60 is rotated to a prescribed angle with respect to the flat plate portion 84*a* of the connecting member 84 corresponding to the inclination of the floor surface 43*a*, the external thread 56*a* of the bolt 56 is not in contact with the inner circumferential surface of the through hole 84*c*.

In this case, the horizontally moving structure 60 is rotated with the part where the convex spherical surface portion 84*f* of the downward protruding portion 84*e* of the connecting member 84 is in contact therewith as the supporting point.

The length dimension between the lower surface of the head portion of the bolt 56 and the upper surface 74*c* of the outer member 74 of the horizontally moving structure 60 is larger than the total of the thickness dimension of the flat plate portion 84*a* of the connecting member 84 and the height dimension of the downward protruding portion 84*e*, and thereby the horizontally moving structure 60 of the base isolation bearing 82 supports from below the flat plate portion 84*a* of the connecting member 84, or the flat plate portion 84*a* of the connecting member 84 is separated from the upper surface 74*c* of the outer member 74 of the horizontally moving structure 60, corresponding to the change of the distance between the lower surface of the flat plate portion 84*a* of the connecting member 84 and the floor surface 43*a* of the sole plate 43.

The base isolation floor structure 80 according to this embodiment provides the same effects as in the base isolation floor structure 40 according to the first embodiment.

Figure 11:
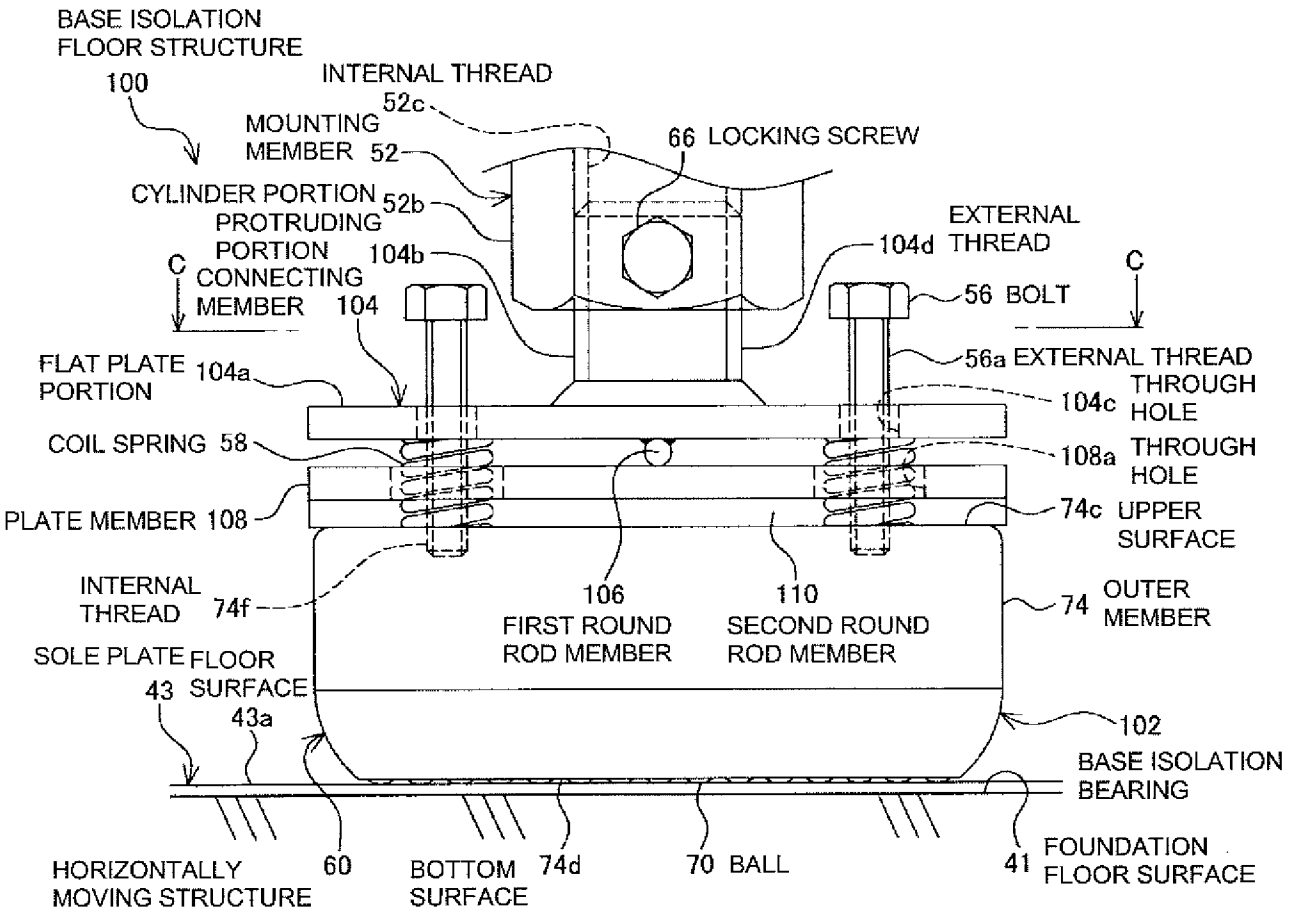
FIG. 11 is a figure showing a base isolation floor structure 100 according to a third embodiment of the invention and is a side view showing an enlarged view around a base isolation bearing 102 thereof.
Figure 12:
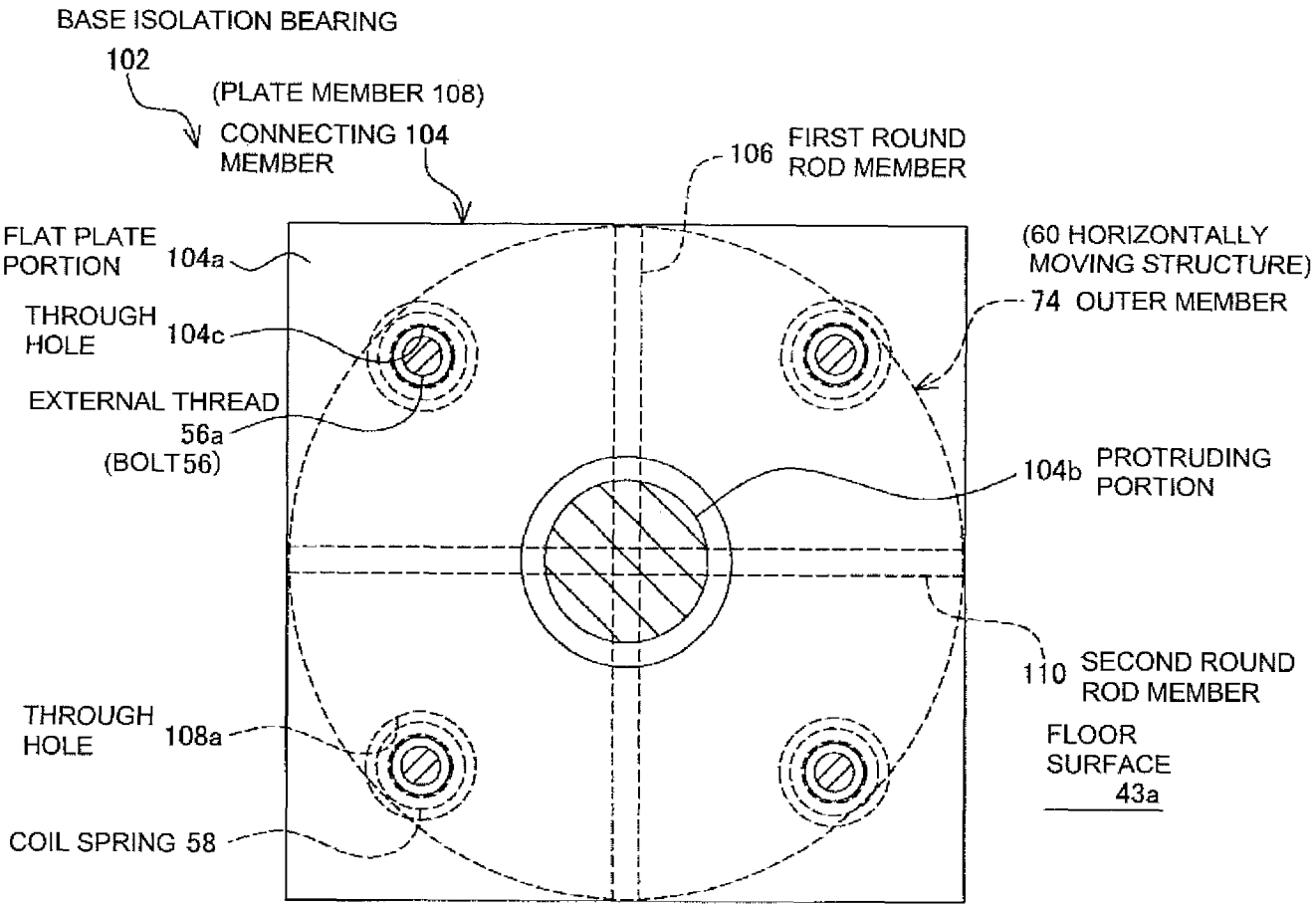
FIG. 12 is a cross sectional view of the base isolation bearing 102 on line C-C in FIG. 11.
Figure 13:
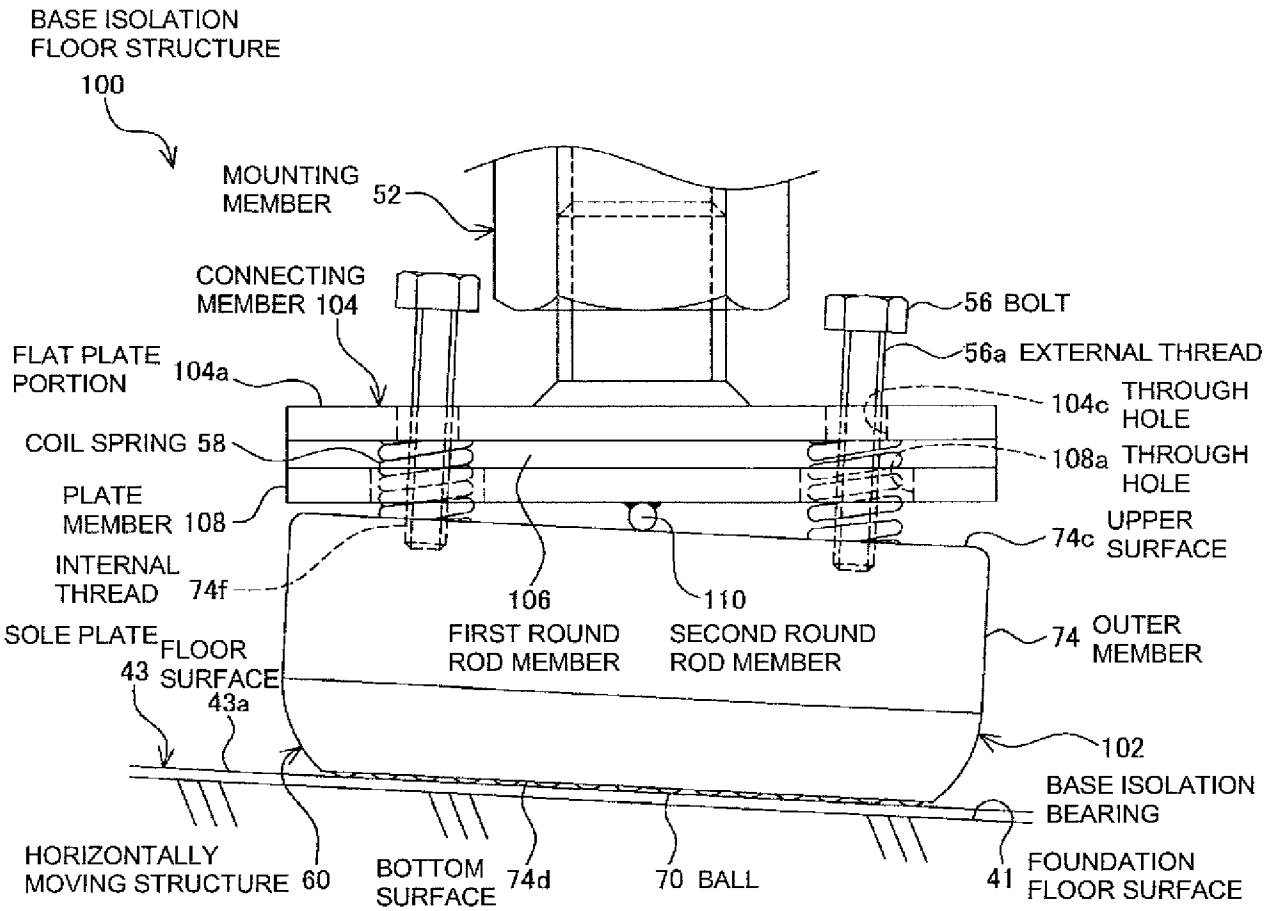
FIG. 13 is a figure showing an enlarged view around the base isolation bearing 102 of the base isolation floor structure 100 with the view point that is rotated 90° in the horizontal plane and is a side view showing the state where the base isolation bearing 102 is placed on an inclined floor surface 43*a*.

FIGS. 11 to 13 are figures for describing a base isolation floor structure 100 according to the third embodiment of the invention.

The base isolation floor structure 100 according to this embodiment is different from the base isolation floor structure 80 according to the second embodiment in the point shown in FIG. 11 that a base isolation bearing 102 has a connecting member 104, a first round rod member 106, a plate member 108 and a second round rod member 110 instead of the connecting member 84 in the second embodiment.

The connecting member 104 in this embodiment has a flat plate portion 104*a*, a protruding portion 104*b* protruding upward having an external thread 104*d*, and a through hole 104*c*, which each correspond to the flat plate portion 84*a*, the protruding portion 84*b* protruding upward having the external thread 84*d*, and the through hole 84*c* of the connecting member 84 in the second embodiment.

The connecting member 104 has on the lower surface of the flat plate portion 104*a* the first round rod member 106, and is integrated with the first round rod member 106 through welding between the lower surface of the flat plate portion 104*a* and the outer circumferential surface of the first round rod member 106.

As shown in FIG. 11, under the flat plate portion 104*a* of the connecting member 104 and the first round rod member 106, the plate member 108 and the second round rod member 110 having the same structure as above are disposed and superimposed on each other.

The plate member 108 of the base isolation bearing 102 is formed in a approximately square plate shape as shown in FIGS. 11 and 12, and through holes 108*a* formed at the four corners thereof are formed with a larger diameter than the through holes 104*c* of the connecting member 104 at the coaxial positions of the through holes 104*c* on superimposing the plate member 108 onto the flat plate portion 104*a* of the connecting member 104. The coil springs 58 are inserted in the through holes 104*c* of the plate member 108, respectively.

The plate member 108 has on the lower surface thereof the second round rod member 110, and is integrated with the second round rod member 110 through welding between the lower surface and the outer circumferential surface of the second round rod member 110.

As shown in FIG. 12, the first round rod member 106 is disposed with the axial line thereof extending in the vertical direction as in the figure at the center position in the horizontal direction as in the figure of the flat plate portion 104*a* of the connecting member 104. The second round rod member 110, on the other hand, is disposed with the axial line thereof extending in the horizontal direction as in the figure at the center position in the vertical direction as in the figure of the flat plate portion 104*a* of the connecting member 104. Accordingly, the first round rod member 106 and the second round rod member 110 are disposed with the axial lines thereof crossed perpendicularly each other as viewed from the above in FIG. 11.

As shown in FIG. 11, the first round rod member 106 is disposed on the upper surface of the plate member 108, and the outer circumferential surface thereof is in contact with the upper surface of the plate member 108 rotatably within a limited angle range.

The second round rod member 110 is disposed on the upper surface 74*c* of the outer member 74 of the horizontally moving structure 60, and the outer circumferential surface thereof is in contact with the upper surface 74*c* of the outer member 74 rotatably within a limited angle range.

As shown in FIG. 11, the external thread 56*a* of the bolt 56 is inserted loosely with an allowance into the through hole 104*c* of the flat plate portion 104*a* of the connecting member 104, and the interior of the coil spring 58 inserted into the through hole 108*a* of the plate member 108, but does not fix them.

Accordingly, the horizontally moving structure 60 is allowed to rotate to a prescribed angle with respect to the flat plate portion 104*a* of the connecting member 104.

As shown in FIG. 13, specifically, in the case where the floor surface 43*a* of the sole plate 43 is inclined in the horizontal direction as in the figure with respect to the horizontal plane, and the horizontally moving structure 60 is rotated to a prescribed angle with respect to the flat plate portion 104*a* of the connecting member 104 corresponding to the inclination of the floor surface 43*a*, the external thread 56*a* of the bolt 56 is not in contact with the inner circumferential surface of the through hole 104*c*.

In this case, the horizontally moving structure 60 is rotated with the part where the outer circumferential surface of the second round rod member 110 is in contact therewith as the supporting point.

In the case where the floor surface 43*a* of the sole plate 43 is inclined in the anteroposterior direction as in FIG. 13 with respect to the horizontal plane, and the horizontally moving structure 60 is rotated to a prescribed angle with respect to the flat plate portion 104*a* of the connecting member 104 corresponding to the inclination of the floor surface 43*a*, the external thread 56*a* of the bolt 56 is not in contact with the inner circumferential surface of the through hole 104*c*.

In this case, the horizontally moving structure 60 is rotated with the part where the outer circumferential surface of the first round rod member 106 is in contact with the upper surface of the plate member 108 as the supporting point.

The length dimension between the lower surface of the head portion of the bolt 56 and the upper surface 74*c* of the outer member 74 is larger than the total of the thickness dimension of the flat plate portion 104*a* of the connecting member 104 and the plate member 108 and the diameter dimension of the first round rod member 106 and the second round rod member 110, and thereby the horizontally moving structure 60 supports from below the flat plate portion 104*a* of the connecting member 104, or the flat plate portion 104*a* of the connecting member 104 is separated from the upper surface 74*c* of the outer member 74, corresponding to the change of the distance between the lower surface of the flat plate portion 104*a* of the connecting member 104 and the floor surface 43*a* of the sole plate 43.

The base isolation floor structure 100 according to this embodiment provides the same advantageous effects as in the base isolation floor structure 40 according to the first embodiment.

Figure 14:
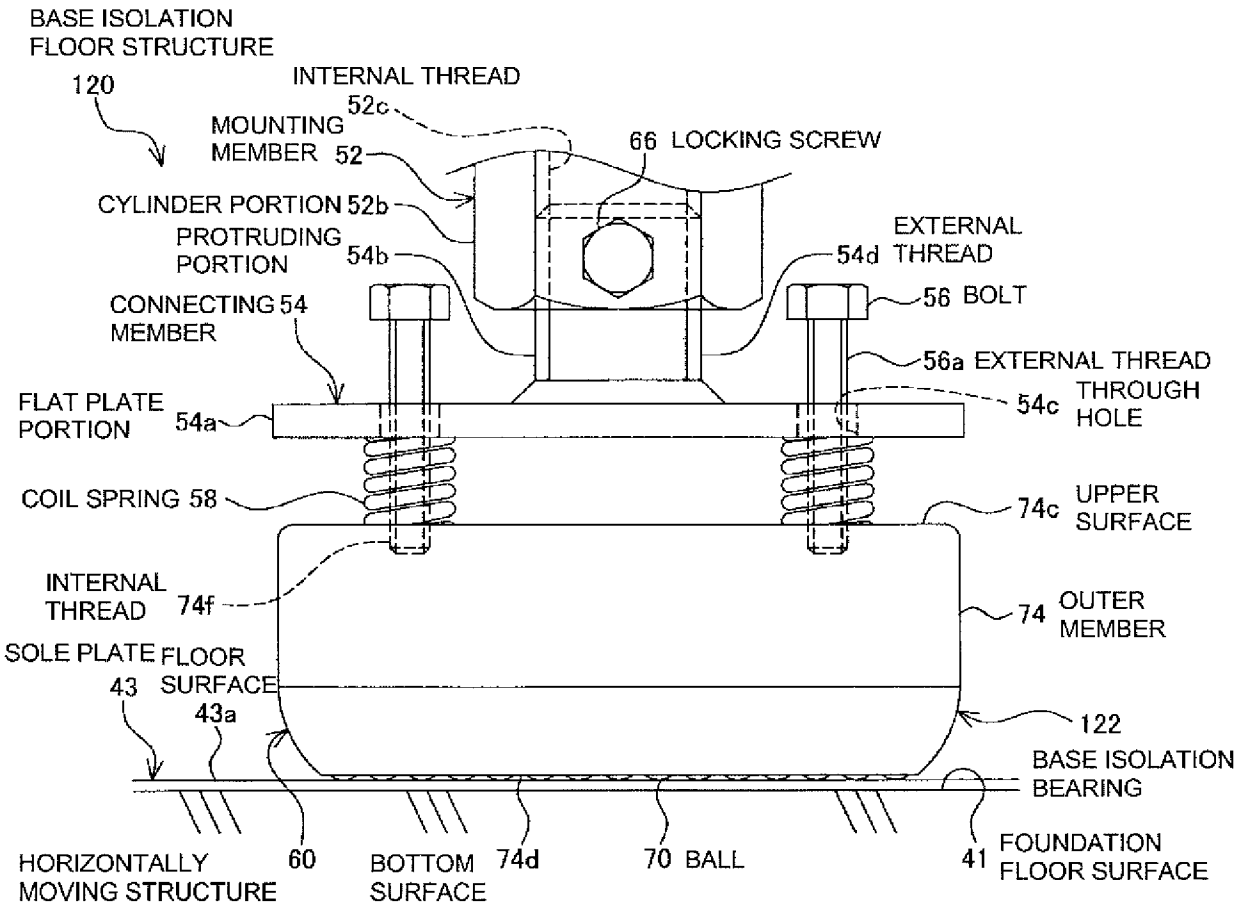
FIG. 14 is a figure showing a base isolation floor structure 120 according to a fourth embodiment of the invention and is a side view showing an enlarged view around a base isolation bearing 122 thereof.
Figure 15:
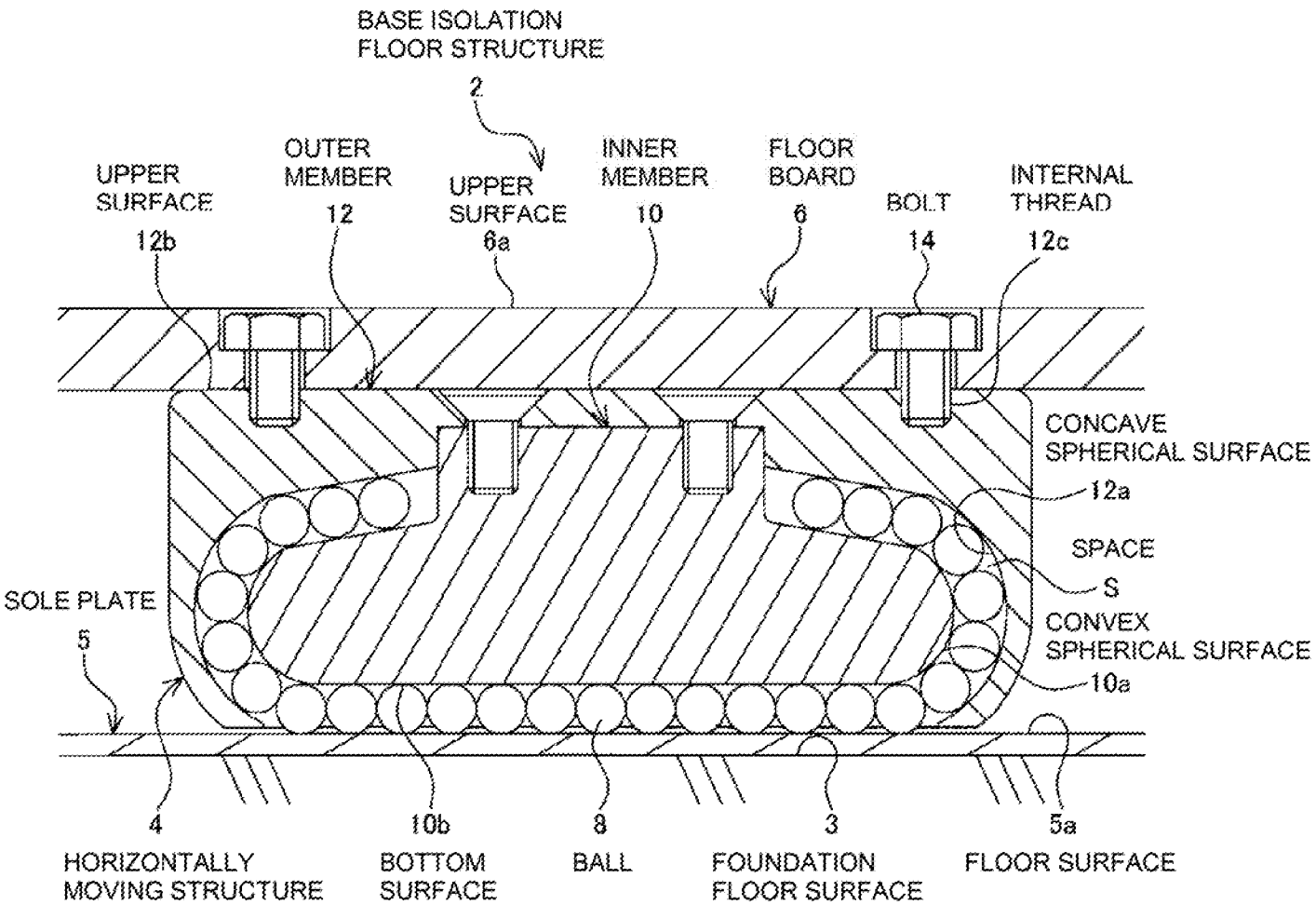
FIG. 15 (Prior Art)
FIG. 15 is a cross sectional side view showing an ordinary base isolation floor structure 2.

FIG. 14 is a figure for describing a base isolation floor structure 120 according to the fourth embodiment of the invention.

The base isolation floor structure 120 according to this embodiment is different from the base isolation floor structure 40 according to the first embodiment in the point shown in FIG. 14 that a base isolation bearing 122 does not have the plate member 62 and the cushion rubber 64 in the first embodiment.

The base isolation floor structure 120 according to this embodiment provides the same advantageous effects as in the base isolation floor structure 40 according to the first embodiment.

The invention is not limited to the aforementioned embodiments, and various changes may be made in the base isolation floor structure within a range that achieves the objects of the invention.

For example, in the base isolation floor structure 40 of the first embodiment, the frames 46 and 48 of the base isolation frame 42 are formed of an H-section steel, but are not limited thereto, and other materials and other shapes may be used.

In the base isolation floor structure 40 of the first embodiment, furthermore, the base isolation bearing 44 has the mounting member 52, the connecting member 54, the bolts 56, the coil springs 58, the horizontally moving structure 60, the plate member 62 and the cushion rubber 64, but a structure having no coil spring 58 may be used.

In the base isolation floor structure 40 of the first embodiment, furthermore, the connecting member 54 is fixed to the base isolation frame 42 through the mounting member 52, but the connecting member 54 may be fixed directly to the base isolation frame 42 without the mounting member 52.

In the base isolation floor structure 40 of the first embodiment, furthermore, the cushion rubber 64 has a approximately square plate shape, and for using efficiently the deflection of the cushion rubber 64, the plate member 62 having the same approximately square plate shape as the cushion rubber 64 is disposed between the cushion rubber 64 and the upper surface 74*c* of the horizontally moving structure 60, but a structure having no plate member 62 may be used.

In the base isolation floor structure 40 of the first embodiment, furthermore, the cushion rubber 64 have the grooves 64*d* and 64*e*, but the grooves 64*d* and 64*e* may not be formed as far as the cushion rubber exhibits the function thereof.

In the base isolation floor structure 40 of the first embodiment, furthermore, the bolt 56 has the head portion and the external thread 56*a*, but the invention is not limited thereto, and a simple rod member having a cylindrical column shape or a rectangular column shape may be used with the lower end thereof being engaged in a recession of the horizontally moving structure 60.

In the base isolation floor structure 40 of the first embodiment, furthermore, the base isolation bearing 44 is placed on the floor surface 43*a* of the sole plate 43, but the base isolation bearing 44 may be placed directly on the foundation floor surface 41.

In the base isolation floor structure 80 of the second embodiment, the convex spherical surface portion 84*f* is provided at the tip end of the downward protruding portion 84*e* of the connecting member 84, but a chamfer portion formed by scraping the corner of the tip end at approximately 45° may be provided instead of the convex spherical surface portion 84*f*.

In the base isolation floor structure 100 of the third embodiment, the two combination, i.e., the connecting member 104 and the first round rod member 106, and the plate member 108 and the second round rod member 110, are disposed and superimposed on each other, but for example, only one combination of the connecting member 104 and the first round rod member 106 may be disposed.

What is claimed is:

1. A base isolation floor structure comprising:

a base isolation frame containing a plurality of frames; and a plurality of base isolation bearings that support the base isolation frame, each of the base isolation bearings comprising:

a base isolation structure that has a plurality of rolling members and is disposed horizontally movably freely on a floor surface;

a connecting member that is disposed above the base isolation structure and is connected to the base isolation frame;

an elastic plate member that is disposed between the connecting member and the base isolation structure; and a rod member having a lower end that is fixed to the base isolation structure, an intermediate portion inserted loosely with an allowance into a through hole formed in the connecting member, and an upper end that protrudes upward from the through hole in the connecting member so that the rod member does not fix the connecting member.

2. The base isolation floor structure according to claim 1, which further comprises a coil spring that is disposed between the connecting member and the base isolation structure.

3. A base isolation floor structure comprising:

a base isolation frame containing a plurality of frames; and a plurality of base isolation bearings that support the base isolation frame, each of the base isolation bearings comprising:

a base isolation structure that has a plurality of rolling members and is disposed horizontally movably freely on a floor surface;

a connecting member that is disposed above the base isolation structure and is connected to the base isolation frame;

a coil spring that is disposed between the connecting member and the base isolation structure; and a rod member having a lower end that extends downward and is fixed to the base isolation structure, an intermediate portion inserted loosely with an allowance into a through hole formed in the connecting member, and an upper end that protrudes upward from the through hole in the connecting member so that the rod member does not fix the connecting member.

4. A base isolation floor structure comprising:

a base isolation frame containing a plurality of frames; and a plurality of base isolation bearings that support the base isolation frame, each of the base isolation bearings comprising:

a base isolation structure that has a plurality of rolling members and is disposed horizontally movably freely on a floor surface;

a connecting member that is disposed above the base isolation structure and is connected to the base isolation frame, said connecting member having a flat plate portion with an upper surface and a lower surface;

an elastic plate member that is disposed between the flat plate portion of the connecting member and the base isolation structure; and a rod member having a lower end that is fixed to the base isolation structure, an intermediate portion inserted loosely with an allowance into a though hole formed in the flat plate portion of the connecting member and a through hole formed in the elastic plate member, and an upper end that protrudes upward from the upper surface of the flat plate portion of the connecting member, wherein a vertical distance between the lower surface of the flat plate portion of the connecting member and the base isolation structure changes corresponding to a change in a vertical distance between the lower surface of the flat plate portion of the connecting member and the floor surface so that the rolling members of the base isolation structure are made in contact with the floor surface.

5. The base isolation floor structure according to claim 4, further comprising a coil spring that is disposed inside of the through hole formed in the elastic plate member, and wherein the intermediate portion of the rod member is inserted loosely with an allowance into the though hole of the flat plate portion of the connecting member, the interior of the coil spring and the though hole of the elastic plate member.

6. A base isolation floor structure comprising:

a base isolation frame containing a plurality of frames; and a plurality of base isolation bearings that support the base isolation frame, each of the base isolation bearings comprising:

a base isolation structure that has a plurality of rolling members and is disposed horizontally movably freely on a floor surface;

a connecting member that is disposed above the base isolation structure and is connected to the base isolation frame, said connecting member having a flat plate portion with an upper surface and a lower surface;

a coil spring disposed between the flat plate portion of the connecting member and the base isolation structure; and a rod member having a lower end that is fixed to the base isolation structure, an intermediate portion inserted loosely with an allowance into though hole formed in the flat plate portion of the connecting member and interior of the coil spring, and an upper end that protrudes upward from the upper surface of the flat plate portion of the connecting member, wherein a vertical distance between the lower surface of the flat plate portion of the connecting member and the base isolation structure changes corresponding to a change in a vertical distance between the lower surface of the flat plate portion of the connecting member and the floor surface so that the rolling members of the base isolation structure are made in contact with the floor surface.

* * * * *